US006672019B1

(12) United States Patent
Wenz

(10) Patent No.: US 6,672,019 B1
(45) Date of Patent: Jan. 6, 2004

(54) MULTI-STOREY PARKING GARAGE

(75) Inventor: Jürgen Otto Wenz, Remchingen (DE)

(73) Assignee: Vollack Parkhaus AG, Karlsruhe (DE)

( * ) Notice: Subject to any disclaimer, the term of this patent is extended or adjusted under 35 U.S.C. 154(b) by 0 days.

(21) Appl. No.: 10/175,386

(22) Filed: Jun. 20, 2002

(51) Int. Cl.[7] ..... E01F 9/00; E04H 6/42
(52) U.S. Cl. ..... 52/174
(58) Field of Search ..... 52/174, 175, 573.1, 52/302.1, 302.3

(56) References Cited

U.S. PATENT DOCUMENTS

| | | | | | |
|---|---|---|---|---|---|
| 4,279,109 | A | * | 7/1981 | Madl, Jr. | 52/263 |
| 4,604,841 | A | * | 8/1986 | Barnoff et al. | 52/174 |
| 4,637,181 | A | * | 1/1987 | Cohen | 52/126.5 |
| 5,025,522 | A | * | 6/1991 | Eshew et al. | 14/73 |
| 5,056,286 | A | * | 10/1991 | Bokor | 52/483 |
| 5,311,629 | A | * | 5/1994 | Smith | 14/73.1 |
| 5,486,392 | A | * | 1/1996 | Green | 428/54 |
| 5,715,636 | A | * | 2/1998 | Taylor | 52/308 |
| 5,822,947 | A | * | 10/1998 | Tarrant | 52/781.3 |
| 5,826,381 | A | | 10/1998 | Sasaki | |
| 6,253,514 | B1 | * | 7/2001 | Jobe et al. | 52/471 |

FOREIGN PATENT DOCUMENTS

| | | |
|---|---|---|
| DE | 298 06 840 | 10/1998 |
| WO | WO 99 45 220 | 10/1999 |

* cited by examiner

*Primary Examiner*—Gwendolyn Baxter
(74) *Attorney, Agent, or Firm*—Paul Vincent

(57) ABSTRACT

A multi-storey parking garage which can be reassembled comprises a skeleton support structure with vertical supports, substantially horizontal ceiling beams and a plurality of floor plates which are supported on the ceiling beams for forming a passable surface, wherein a gap formed between neighboring floor plates extends above a ceiling beam in the longitudinal direction thereof. The floor plates are disposed on the ceiling beams with the interposition of a groove-shaped profiled body, in particular of an elastic plastic material. The profiled body extends in the longitudinal direction of the gap below same and serves for accepting and draining liquid dropping onto the floor plates.

8 Claims, 2 Drawing Sheets

MULTI-STOREY PARKING GARAGE

This application is related to DE 199 62 547 filed Dec. 23, 1999 the complete disclosure of which is hereby incorporated by reference.

BACKGROUND OF THE INVENTION

The invention concerns a multi-storey parking garage which can be reassembled, comprising a skeleton support structure with vertical supports, substantially horizontal ceiling beams and a plurality of floor plates which are supported on the ceiling beams for forming a passable surface, wherein a gap formed between neighboring floor plates extends above a ceiling beam in the longitudinal direction thereof.

Multi-storey parking garages are conventionally produced substantially from concrete by forming supports and ceilings of concrete between concrete supports produced at the building site or delivered as a finished part to serve as a parking and driving surface. Multi-storey parking garages of this type are appropriate for stationary buildings intended for permanent use although production of site-mixed concrete components requires corresponding weather conditions and the concrete, due to its large weight, results in structural components which are relatively large and heavy for a given load capacity.

DE 298 09 011 U1 discloses a multi-storey parking garage for reassembly whose support structure consists of a steel skeleton with vertical supports and horizontal ceiling beams. Floor plates of steel, concrete or of a steel-concrete composite construction are mounted to the steel frame structure by disposing them on the ceiling beams and screwing them to the respective ceiling beam. To prevent liquid and other soiling matter entering from the upper side of the floor plates of a ceiling level from reaching the vehicles on the ceiling level below, a layer of sheet metal pieces is disposed onto the ceiling beams below the floor plates and are also screwed to the ceiling beams.

Leaks often occur in the vicinity of the mounting locations, i.e. at the screw holes where the mounting screw penetrates through the sheet metal and the upper flange of the ceiling beam and are difficult or impossible to seal. Water, fuel, oil or other liquids can therefore drip onto the underlying vehicles.

DE 298 06 840 U1 describes a similar multi-storey parking garage for reassembly wherein the floor plates are disposed such that the gaps or joints formed between neighboring floor plates extend above a ceiling beam in the longitudinal direction thereof. Elastic joint sealings are inserted into the gaps and joints to seal same. The floor plates are mutually tensioned in the plane of the plates using special tensioning members, thereby also loading the joint sealings. Although this produces improved sealing between the gaps and joints of adjacent floor plates, such a multi-storey parking garage for reassembly requires a great degree of assembly effort thereby causing it to be generally uneconomical.

Moreover, the acoustical insulation between the floor plates and the ceiling beams is disadvantageously unacceptable or can only be achieved at great expense.

It is the underlying purpose of the invention to produce a multi-storey parking garage for reassembly of the above-mentioned kind with which these problems are eliminated and which has floor plates disposed on the ceiling beams in a sealing and acoustically insulating fashion.

SUMMARY OF THE INVENTION

This object is achieved in accordance with the invention in a multi-storey parking garage for reassembly in that the floor plates are disposed onto the ceiling beams by interposing a groove-shaped profiled body, wherein the profiled body extends below and in the longitudinal direction of the gap.

The floor plates which are each individually formed as liquid-tight partial surfaces are not directly supported on the respective ceiling beam. The groove-shaped profiled body is interposed to provide acoustical insulation, sealing and drainage of liquids.

Liquid accumulating on the upper side of a floor plate can flow to the edge thereof and drop down through the gap formed between neighboring floor plates. The groove-shaped profiled body is disposed below this gap and receives the dropping liquid to divert it, within its groove in the longitudinal direction. This prevents the liquid from reaching an underlying level of the multi-storey parking garage.

The profiled body is preferably formed of an elastic plastic material to effect acoustical separation between the floor plate and the ceiling beam and to also seal these structural components.

In a preferred embodiment of the invention, the ceiling beam has an I-shaped profile and the groove-shaped profiled body is disposed at its lower side on the upper flange of the ceiling beam, preferably across its entire surface. The profiled body can be glued onto the ceiling beam for exact positioning thereof. The profiled body preferably has a U-shaped cross-section which is open towards the top, wherein an edge region of a floor plate is disposed on the upper side of each U-shaped leg of the profiled body. Sealing between the floor plate and the profiled body and between the profiled body and the ceiling beam can be provided through the natural weight of the floor plate. However, a tensioning device is preferably additionally provided between the floor plate and the ceiling beam for tensioning the floor plate against the profiled body. The tensioning device accepts transverse loads which tend to lift the floor plate from the ceiling beam.

Reliable drainage of the liquid reaching the groove-shaped profiled body can be achieved if the ceiling beam and hence also the groove-shaped profiled body are slightly inclined in the longitudinal direction. The liquid is discharged to a discharge system at the end of the groove-shaped profiled body in a conventional fashion.

If the groove-shaped profiled body must be examined or cleaned of foreign bodies accumulated therein, appropriate maintenance work can be carried out between the gap formed between the neighboring floor plates. Towards this end, the gap has a width of between approximately 15 mm and 30 mm.

Further details and features of the invention can be extracted from the following description of an embodiment with reference to the drawing.

DESCRIPTION OF THE PREFERRED EMBODIMENT

Figure 1:
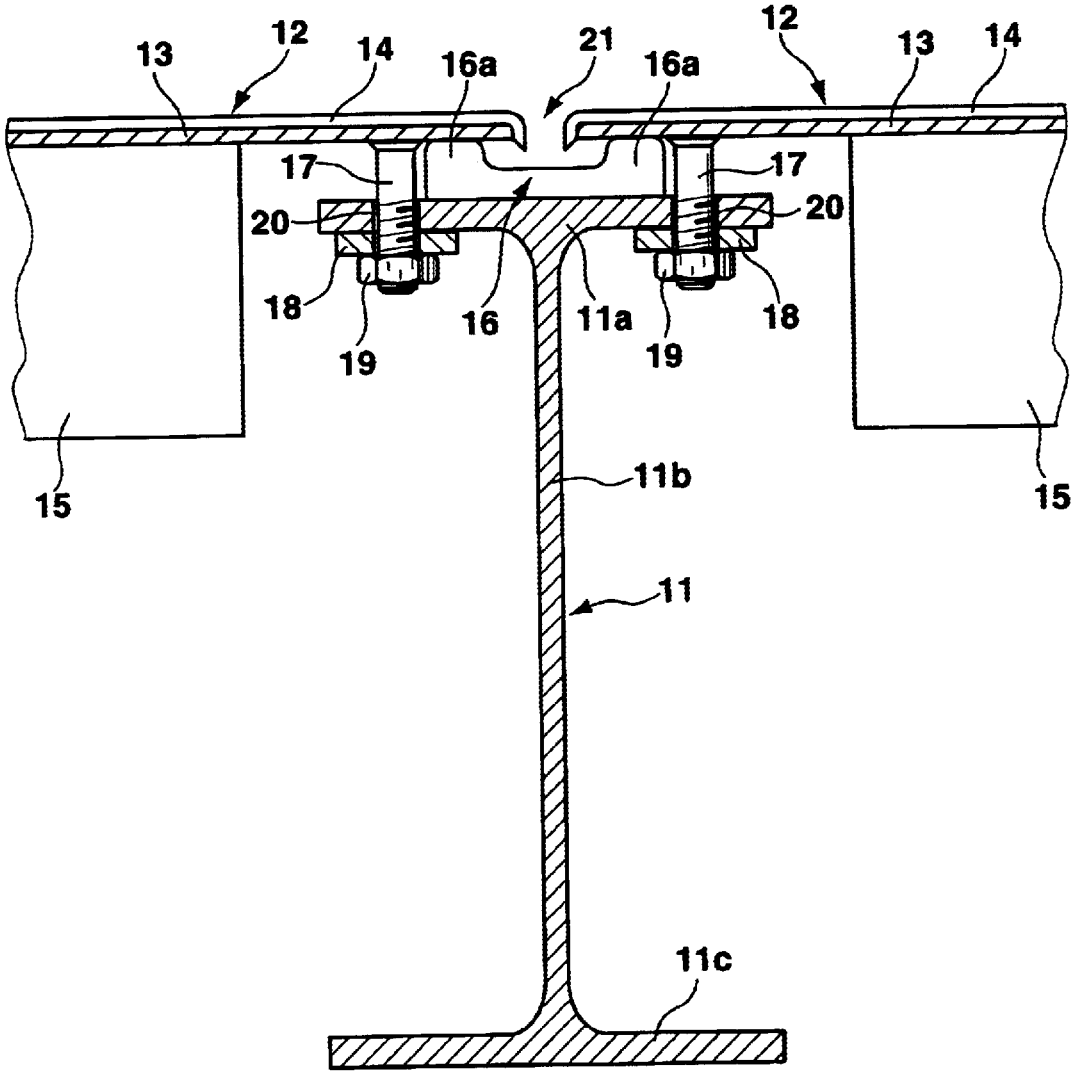
FIG. 1 shows a vertical section through floor plates mounted on a ceiling beam.

A skeleton support structure of a multi-storey parking garage for reassembly comprises several parallel, substantially horizontal support beams 11, of which only one is shown by way of example in the figure. The ceiling beam 11 has an I-shaped profile with an upper flange 11*a*, a vertical bar 11*b* and a lower flange 11*c*. A groove-shaped profiled body 16 is disposed on the upper side of the upper flange 11*a* of the ceiling beam 11 and has a U-shaped cross-section which is open towards the top and which is made from an elastic plastic material, in particular an elastomer. The profiled body 16 extends in the longitudinal direction of the ceiling beam 11 and is preferably produced as a continuous, gap-free structural component.

Bores 20 are formed in the upper flange 11*a* of the ceiling beam 11 beside the profiled body 16.

A floor plate 12 comprises a support layer 13 preferably formed as a steel sheet whose upper side is provided with a protective layer or coating 14 which extends to the side surfaces of the support layer 13. The lower side of the floor plate 12 has reinforcements 15 (only schematically shown) and several downwardly projecting, threaded bolts 17 which are welded to the floor plate 12 close to its edge region.

For mounting, the floor plate 12 is disposed with its edge region on the upper side of a U-shaped leg 16*a* of the groove-shaped profiled body 16 and the threaded bolt 17 is introduced into the bore 20 of the upper flange 11*a* of the ceiling beam 11 such that it projects downwardly from same. The floor plate 12 is then tensioned in the direction of the upper flange 11*a* by means of a spacer 18 and a nut 19, whereby pressure is exerted on the U-shaped leg 16*a* of the profiled body 16.

As seen in the figure, a gap 21 formed between neighboring floor plates 12 is disposed above the groove-shaped profiled body 16 and extends in its longitudinal direction such that water or other liquid reaching the gap 21 is accepted and drained by the profiled body 16. To support drainage, the ceiling beam 11 and also the profiled body 16 are slightly inclined in the longitudinal direction, i.e. perpendicular to the plane of the drawing.

Figure 2:
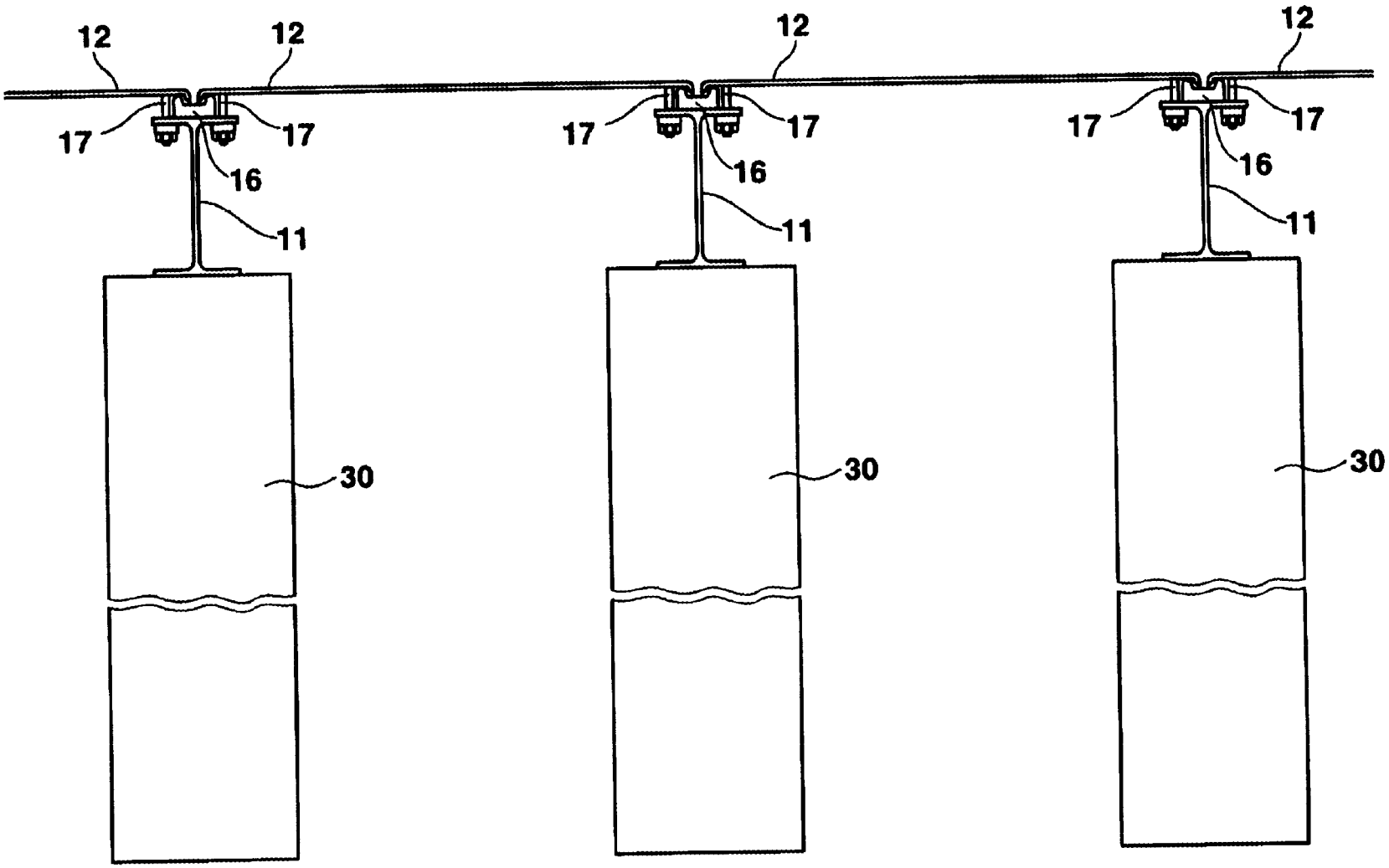
FIG. 2 shows a vertical section through a plurality of floor plates mounted on ceiling beams.

FIG. 2 shows a vertical section corresponding to FIG. 1 but for a plurality of floor plates 12 mounted to a plurality of ceiling beams 11. The horizontal ceiling beams 11 seal on vertical supports 30 to define a skeletal support structure.

What is claimed is:

1. A multi-storey parking garage, the parking garage comprising:

substantially vertical supports;

substantially horizontal ceiling beams seated on said vertical supports to define a skeletal support structure;

a plurality of groove-shaped, profiled bodies, each of said profiled bodies seating on an associated one of said ceiling beams and extending substantially along a longitudinal travel of said associated ceiling beam; and a plurality of floor plates supported on said profiled bodies for forming a passable surface, said floor plates defining gaps between neighboring floor plates, said gaps disposed directly above an associated one of said profiled bodies and extending along said longitudinal travel of an associated supporting one of said ceiling beams.

2. The multi-storey parking garage of claim 1, wherein each of said ceiling beams has an I-shaped cross-section, each of said profiled bodies being supported at a lower side thereof to seat on an upper flange of said associated ceiling beam.

3. The multi-storey parking garage of claim 1, wherein each of said profiled bodies consists essentially of an elastic plastic material.

4. The multi-storey parking garage of claim 1, wherein each of said profiled bodies has a U-shaped cross-section, wherein each of said gaps is disposed above a central portion of said U-shaped cross-section.

5. The multi-storey parking garage of claim 4, wherein an edge region of each of said floor plates seats on an, upper side of a leg of one of said profiled bodies.

6. The multi-storey parking garage of claim 1, further comprising a plurality of tensioning devices, each of said tensioning devices cooperating with one of said floor plates and an associated one of said ceiling beams to tension said one of said floor plates to an associated one of said profiled bodies.

7. The multi-storey parking garage of claim 1, wherein each of said ceiling beams and each of said profiled bodies is inclined in said longitudinal direction.

8. The multi-storey parking garage of claim 1, wherein each of said gaps has a width of between 15 mm and 30 mm.

* * * * *